United States Patent [19]

Watanabe et al.

[11] 4,230,787

[45] Oct. 28, 1980

[54] MAGNETIC TONER FOR DEVELOPING LATENT ELECTROSTATIC IMAGES AND A PROCESS FOR THE PREPARATION THEREOF

[75] Inventors: Shotaro Watanabe, Machida; Katsutoshi Tozawa, Kokubunji; Shigeru Uetake, Sayama, all of Japan

[73] Assignee: Konishiroku Photo Industry Co., Ltd., Nihonbashi, Japan

[21] Appl. No.: 822,786

[22] Filed: Aug. 8, 1977

[30] Foreign Application Priority Data

Aug. 10, 1976 [JP] Japan ..... 51/95197

[51] Int. Cl.[2] ..... G03G 9/08; G03G 9/14

[52] U.S. Cl. ..... 430/107; 430/137; 430/122; 428/407; 427/214; 252/62.54

[58] Field of Search ..... 252/62.1 P, 62.1 R, 252/62.54; 96/15 D; 428/407; 427/214

[56] References Cited

U.S. PATENT DOCUMENTS

| | | | |
|---|---|---|---|
| 2,890,968 | 6/1959 | Giaimo | 252/62 P |
| 3,669,922 | 6/1972 | Bartsch et al. | 252/62.1 P |
| 3,698,005 | 10/1972 | Nacci et al. | 252/62.1 P |
| 3,900,587 | 8/1975 | Lenhard et al. | 252/62.1 P |

FOREIGN PATENT DOCUMENTS

| | | | |
|---|---|---|---|
| 50-90335 | 7/1975 | Japan | 252/62.1 P |
| 51-42539 | 4/1976 | Japan | 96/15 D |

*Primary Examiner*—Roland E. Martin, Jr.
*Attorney, Agent, or Firm*—Finnegan, Henderson, Farabow, Garrett & Dunner

[57] ABSTRACT

A one-component developer for developing a latent electrostatic image which comprises magnetic particles, thermoplastic resins and electric charge controlling dyestuffs as main components and in which the magnetic particles are substantially coated with the electric charge controlling dyestuffs. The resulting toner forms no fringe or ghost and has good duplicativity of half-tone images. The toner is made by coating the magnetic particles with the electric charge controlling dyestuffs before mixing the magnetic particles with the resin.

8 Claims, No Drawings

MAGNETIC TONER FOR DEVELOPING LATENT ELECTROSTATIC IMAGES AND A PROCESS FOR THE PREPARATION THEREOF

The present invention has improved said toner so as to eliminate such demerits.

That is, the present invention relates to the developer which comprises the magnetic particles, thermoplastic resins and electric charge controlling dyestuffs as a main component and in which the magnetic particles are substantially coated with the electric charge controlling dyestuffs. By this, a toner forming no fringe or ghost and having a good duplicativity of halftone images has been obtained.

Further more the reproducibility in preparing said toner is good.

The present invention relates to a toner for developing a latent electrostatic image and particularly to an electrically insulating toner containing magnetic particles.

As conventional dry developers for developing a latent electrostatic image so far widely used is listed a two-component developer consisting of a carrier and a toner used in a magnetic brush developing method or a cascade developing method. This developer gives a good image at an initial stage but has disadvantages that through its long use, images deteriorate owing to fatigue of a carrier, variations of the ratio of mixing between the carrier and the toner, etc. In contrast, there is a onecomponent developer having as its main component a toner alone and containing no carrier particles. This developer does not have the aforementioned disadvantages.

As the developer put into practical use now, there is, for instance, known an electrically conductive magnetic toner for one-component developer, which is described in U.S. Pat. No. 3,639,245.

The magnetic toner disclosed in the patent consists of fine magnetic particles such as ferrosoferric oxide particles and thermoplastic resins such as epoxy resin, said magnetic toner being covered with an electrically conductive carbon black. Thus obtained toner is substantially an electrically conductive one. In consequence, there is the disadvantage in the toner that in transferring onto the paper, the sharpness of images decreases and good images are hard to obtain.

In order to improve this disadvantage, the inventors have developed an electrically insulating magnetic toner comprising the resins and magnetic particles as a main component disclosed in Laid-open Japanese patent No. 45,639/75; Laid-open Japanese Patent No. 62,638/75, Laid-open Japanese Patent No. 26,046/76, or Laid-open Japanese Patent No. 67,330/77.

This toner is used as an one-component developer and in order to electrically charge this toner, it is sufficient for us to just rotate said toner on a sleeve as described in said patents; and friction with a carrier or electrical charging procedures by corona discharge are not required, and in the transferring onto the paper, transferring the corona discharge is possible because of its being an electrically insulating toner. However, one-component developers using such a magnetic toner have disadvantage, in the view of the images, as compared with images from the conventional two-component developer, that they form ghost or fringe and are more or less inferior in resolution; there are some problems in duplicativity of halftone images, allowance for the performance of a photosensitive material is narrow and the reproducibility in preparing a toner is bad, and they are far from satisfactory.

The inventors have wrestled with this problem to find a process for the preparation of a toner having no ghosts or fringes, with little or no sticking between highly dense fine lines or in spaces of halftone dots and little dispersion from lot to lot in preparing the toner. That is, the main components of the toner prepared by the present process are magnetic particles, a thermoplastic resin and an electric charge-controlling dyestuff. The specific resistance value of the toner is $10^{13}\Omega$cm or above, preferably about $10^{14}$–$10^{17}\Omega$cm. The magnetic toner of the present invention, which is electrically insulating, is different from the conventional electrically conductive magnetic toner; fringes have been decreased and the sharpness of images enhanced by adhering an electric charge-controlling dyestuff to magnetic particles. Further, it has been found that dispersion alone of the electric charge-controlling dyestuff in a thermoplastic resin is not sufficient; and that a toner having no fringes or ghosts and having a good duplicativity of halftone images is obtainable by coating the surface of the magnetic particles with an electric charge-controlling dyestuff, and then dispersing the particles in the resin. The electrically insulating magnetic toner will be described below, but it is easily understood that the art of the present invention is applicable to not only such a toner but also an electrically insulating magnetic toner to be used after being electrically charged with a corona discharger.

As a method of surface treatment of the magnetic particles to be used in the present invention, steeping alone has a tentative effect but, if after steeping the magnetic particles in organic solvent solution of an electric charge-controlling dyestuff, the magnetic particles are dispersed with a ball mill, a homomixer, a supersonic disperser, etc. the more favorable result is obtained. Further, the electric charge-controlling dyestuff and the magnetic particles may be mixed in the dry state and subjected to surface treatment, but the result is inferior to that of the steeping method. As a method of removing the solvent after steeping, an optional method such as filtration, heating, reduced pressure and air drying is applicable, but from the standpoints of anti-environmental pollution policy, saving of resources and adsorbing properties of coloring matter is desirable a method of removing it by heating it at atmospheric pressure, cooling solvent vapor and recovering it.

As organic solvents are listed methanol, acetone, benzene chloroform, etc., but if they are a good solvent to dyestuffs, other solvents are also possible to use and as the usage of the solvent, the amount enough to steep magnetic particles will do.

As magnetic particles to be used in the present invention, magnetite (ferrosoferric oxide) is best since it is desirable that they be preferably black, well dispersed in the resin, chemically stable and further can be easily made as fine particles of 1 micron or below in particle diameter. There can also be used a simple substance such as iron, cobalt and nickel or an alloy or compound of those elements showing ferromagnetism or an alloy which is caused to show ferromagnetism by proper heat-treatment though it does not contain ferromagnetic elements, such as manganese-copper-aluminum, or chromium dioxide, etc. It is desirable that these magnetic particles be 1 micron or below in average particle diameter and that the content of them in a toner is 30–70 parts by weight of the toner. If the content of the ferromagnetic substance in the toner is less than 30% by weight, efficiency to carry a toner by magnetic force is poor, and when it is more than 70% by weight, electrical insulation properties will be lost and it becomes impossible to produce the effect of the present invention. And as an electric charge-controlling dyestuff can be used azo dyes, azine dyes, anthraquinone dyes, phthalocyanine dyes and other electric charge-controlling agents known in this field, for instance, Oil Black BS (made by Orient Chemical), Ruksol Fast Blue—AR (made by E.I. du Pont), nigrosine SSB (C.I. 50415), saffron T (C.I. 50240), alizarine orange G (C.I. 58250), Azo Oil Black 7 (made by Allied Chemical) and oil blue—A (C.I. 61551), and further higher fatty acid salts, resinates or metallic salts, of these dyes can be used. As to the amount to be used, 0.02–5 parts by weight based on 100 parts by weight of the magnetic substance powders is preferable. In some cases, if the usage is less, the effect of electric charge control of a toner is not produced and if it is too much, the electrical insulation properties of the toner lower.

In mixing and dispersing in the dry or wet system a dyestuff and magnetic particles and forming dyestuff layer on the surface of the magnetic particles as mentioned before, either dry coating with a mixture of the dyestuff and a small amount of a resin in the dry system or coating by the steeping in dyestuff solution containing a small amount of the resin may be conducted. The amount of addition of said small amount of the resin is preferably 0.02–5% by weight based on the magnetic toner.

As a binder resin there are epoxy resins, styrene resins, polyester resins, acrylic resins, vinyl resins, polyamide resins, phenol resins, terpene resins, petroleum resins, rosin esters, etc., which can be used as a binder for a powdery toner, and a type of resin is selected mainly by a type of photosensitive substance or a fixing system of a toner image. The content of the resin is preferably 70–30 parts by weight based on 100 parts by weight of the toner.

And except the magnetic substance powders, electric charge-controlling agents and resins, an additive such as carbon black and other pigments, various types of waxes, metallic soaps, higher fatty acids and higher alcohols can be contained in small amounts.

For the preparation of a developer of the present invention can be used the conventional crushing and granulation method. For instance, magnetic particles coated with the electric charge controlling dyestuffs, the thermoplastic resins and additives are mixed by a roll mixer, a kneader mixer, an extruder, then cooled and crushed with a hammer mill or a jet mill, etc. Later as described in Laid-open Japanese Patent No. 67330/77, said crushed particles are sprayed into a hot gas current to eliminate fine powders 1 micron or below in particle diameter and actually spherical toner particles are obtained. Said toner is classified with a wind classifier to obtain a toner with the desired particle diameter. To prevent the cohesion of the toner and elevate its fluidity, it is possible to add hydrophobic silica fine powders to the toner in the procedure before or after said treatment for making toner particles spherical.

Then, the present invention will be specifically described with reference to Examples but the embodiments of the present invention are not limited by this.

CONTROL 1

Thirty-two parts of terpene resin YS Resin $P_X$ 1150 (made by Yasuhara Yushi), 6 parts of Evaflex 260 ethylenevinyl acetate copolymer resin (made by Mitsui Polychemical), 4 parts of Eslek BL-S, polyvinyl-butyral resin (made by Sekisui Chemical), 1 part of Kalnabarrow Wax (made by Kanto Chemical), 2 parts of carbon black Peerless 155 (made by Columbian Carbon) and 55 parts of ferrosoferric oxide Mapico Black BL-500 (made by Chitan Kogyo)—this composition was heat kneaded with a two-roll mixer, and then cooled and set up. It was made into a particle size of 1 mm or below in average particle diameter with a wiley crusher, which is a kind of impact-type crusher and mixed and thoroughly heat kneaded again with a two-roll mixer. Then, it was cooled and set up and crushed to obtain finely crushed particles 13 microns in average particle diameter. Further, to these finely crushed particles were added and mixed 0.1% by weight of hydrophobic silica fine powders, Aerosil R-972 (made by Japan Aerosil) and blown into a hot gas current of about 250° C. with the use of air nozzles for heat-treatment. Further, to them was added and mixed 0.1% by weight of Aerosil R-972 to obtain a toner 5–20 microns in particle diameter with a zigzag classifier.

With the use of this toner, the toner image was formed on a Zinc oxide photosensitive paper, by using the developing device described in Laid-open Japanese Patent No. 26,046/76, which was mounted on a U-BIX 800 type electronic copying machine by Konishiroku Photo Industry; then said toner image was transferred onto the plain paper. In the obtained images, many phenomena of fringes, blurring, fogs or ghosts occurred and sharpness and resolution were poor, resulting in being unable to be put into practical use.

CONTROL 2

To 100 parts of the finely crushed particles 13 microns in particle size obtained in Control 1 was added and fully premixed 0.8 part of Oil Black BS (electric charge-controlling agent). Then, exactly as in Control 1, it was heat kneaded twice with a two-roll mixer, crushed, heat-treated and classified to obtain a toner. With this toner, copying test was carried out as in Control 1. The obtained images were not much different from those in Control 1.

EXAMPLE 1

Thirty-two parts of YS Resin $P_X$ 1150, 6 parts of Evaflex 260, 4 parts of Eslek BL-S and one part of Kalnabarrow were heat kneaded with a two-roll mixer and a premixed one of 2 parts of Peerless 155, 55 parts of Mapico Black BL-500 and 0.8 part of Oil Black BS (made by Orient Chemical) was slowly supplemented to said heat kneaded matter; after thorough heat kneading, as in Control 1, crushing, heat-treatment and classification were conducted to obtain a toner. The images obtained by this toner largely overcame the imperfections of Controls 1 and 2.

CONTROL 3

In 40 parts of chloroform was dissolved 0.5 part of Oil Black BS and further two parts of Peerless 155 was added, well dispersed. Later, it was heat dried at normal pressure to obtain a mixture of an electric charge controlling agent and carbon black. The composition in which Peerless 155 was removed from the composition in Control 1 was heat kneaded with a two-roll mixer; further said mixture of an electric charge-controlling agent and carbon black was supplemented into said composition and thoroughly kneaded to obtain a toner as in Control 1. The images obtained by this toner were the same as in Controls 1 and 2.

EXAMPLE 2

In 60 parts of chloroform was dissolved 0.8 part of Oil Black BS and further 55 parts of Mapico Black BL-500 were steeped and well agitated with a homomixer. At this time, the color density of the supernatant liquid lowered to an extent that it could be judged with the naked eye. Later, it was heated and dried at normal pressure to obtain magnetic particles the surface of which were coated with an electric charge-controlling agents. Now, untreated Mapico Black BL-500 quickly sinks, if it is scattered on the water surface, but the Mapico Black BL-500 the surface of which was treated with said electric charge-controlling agent floated on the water surface. The one in which Mapico Black BL-500 was removed from the composition in Control 1 was heat kneaded with a two-roll mixer, and then the magnetic particles the surface of which were coated with said electric charge-controlling agent were slowly supplemented and thoroughly heat kneaded to obtain a toner as in Control 1. The images obtained from this toner have no fringes or blurring and toner adhesion in the spaces of halftone dots was less; also in resolution, they were more improved than those in Example 1.

EXAMPLE 3

The process for preparing a toner in Example 2 was followed in the same manner except that the amount of addition of Oil Black BS was changed into 0.02 part. When 55 parts of Mapico Black BL-500 were steeped and agitated in a chloroform solution of Oil Black BS, the solution, the blackish violet solution became almost colorless and transparent. The images obtained from the thus prescribed toner were in the same degree as in Example 1.

CONTROL 4

A composition of 40 parts of styrene (95 mol%), diethylaminoethylmethacrylate (5 mol%) copolymer and 60 parts of Mapico Black BL-100 (magnetic particles) was premixed and then a toner was obtained as in Control 1. This copolymer is an electric charge-controlling resin and can give good images, but two in 5 lots in manufacturing the toner had fringes, and resolution and halftone images deteriorated.

EXAMPLE 4

In place of Mapico Black BL-100 in Control 4, were used 60 parts of Mapico Black BL-100 obtained by removing solvent after the steeping with agitation in a chloroform solution containing 1 part of nigrosine SSB (electric charge-controlling agent). With this toner, none of 5 lots formed fringes.

Further, resolutions of images obtained in each Control and Example are given in Table 1.

TABLE 1

| Control and Example NO. | Resolution |
|---|---|
| Control 1 | 4/mm |
| " 2 | 4.5/mm |
| " 3 | 4.5/mm |
| " 4 | 5–6/mm |
| Example 1 | 6/mm |
| " 2 | 8/mm |
| " 3 | 6/mm |
| " 4 | 8/mm |

What is claimed is:

1. In a one component developer for developing a latent electrostatic image, a magnetic toner containing magnetic particles and binder resins as main components, the improvement comprising said magnetic particles being substantially coated with electric charge-controlling dyestuffs before being combined with said binder resins, the content of said magnetic particles being 30 to 70% by weight, the content of said electric charge-controlling dyestuffs being 0.02 to 5% by weight and the specific resistance of said magnetic toner being at least $10^{13}\Omega$cm.

2. The magnetic toner as set forth in claim 1 in which said magnetic particles are iron, cobalt, nickel and an alloy or oxide thereof, ferrite, manganese-copper-aluminum, chromium dioxide ferro magnetic alloys or mixtures thereof.

3. The magnetic toner as set forth in claim 1 in which the main component of said binder resins are styrene resins, epoxy resins, polyester resins, acrylic resins, vinyl resins, polyamide resins, phenol resins, terpene resins, petroleum resins, rosin ester resins or mixtures thereof.

4. The magnetic toner as set forth in claim 3 in which the content of said binder resins is 30 to 70% by weight.

5. The magnetic toner as set forth in claim 1 in which the content of said binder resins is 30 to 70% by weight.

6. The magnetic toner as set forth in claim 1 in which the electric charge-controlling dyestuffs are selected from the group consisting of azo dyes, azine dyes, anthraquinone dyes, phthalocyanine dyestuffs, and higher fatty acid salts, resinates, and metallic salts of said electric charge-controlling dyestuffs.

7. In a process for the preparation of a magnetic toner used in a one component developer for developing a latent electrostatic image containing as main components magnetic particles and binder resins, the improvement comprising dissolving electric charge-controlling dyestuffs in a solvent to obtain a dyestuff solution, steeping or dispersing said magnetic particles into said dyestuff solution, removing said solvent from said magnetic particles to obtain dyed magnetic particles, mixing said dyed magnetic particles with said binder resins, heat kneading, cooling, and crushing the mixture, the content of said magnetic particles being 30 to 70% by weight, the content of said charge-controlling dyestuffs being 0.02 to 5% by weight, and the specific resistance of said magnetic toner being at least $10^{13}\Omega$cm.

8. The process for the preparation of magnetic toner as set forth in claim 7, further comprising heat treating the crushed mixture with a hot gas current.

* * * * *